US011446935B2

(12) United States Patent
Hamada

(10) Patent No.: US 11,446,935 B2
(45) Date of Patent: Sep. 20, 2022

(54) PRINTING APPARATUS AND CONTROL METHOD THEREFOR

(71) Applicant: CANON KABUSHIKI KAISHA, Tokyo (JP)

(72) Inventor: Takuya Hamada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/016,763

(22) Filed: Sep. 10, 2020

(65) Prior Publication Data

US 2021/0070068 A1 Mar. 11, 2021

(30) Foreign Application Priority Data

Sep. 10, 2019 (JP) ..... JP2019-164784

(51) Int. Cl.
*B41J 11/00* (2006.01)

(52) U.S. Cl.
CPC ..... *B41J 11/0005* (2013.01); *B41J 11/002* (2013.01); *B41J 11/005* (2013.01); *B41J 11/0045* (2013.01)

(58) Field of Classification Search
CPC .... B41J 11/0005; B41J 11/002; B41J 11/0045
See application file for complete search history.

(56) References Cited

U.S. PATENT DOCUMENTS

2017/0050448 A1* 2/2017 Jang ..... B41J 11/0005
2018/0207945 A1* 7/2018 Ogasahara ..... B41J 2/2135
2020/0398555 A1* 12/2020 Nishihara ..... B41J 2/155

FOREIGN PATENT DOCUMENTS

JP 09-114267 A 5/1997
JP 2009-012414 A 1/2009

OTHER PUBLICATIONS

U.S. Appl. No. 16/990,452, Takuya Hamada, filed Aug. 11, 2020.
U.S. Appl. No. 16/990,722, Takuya Hamada, filed Aug. 11, 2020.

* cited by examiner

*Primary Examiner* — Matthew Luu
*Assistant Examiner* — Kendrick X Liu
(74) *Attorney, Agent, or Firm* — Venable LLP

(57) ABSTRACT

A printing apparatus includes a conveyance unit configured to convey a print medium, a printhead configured to print an image by discharging ink to the print medium conveyed by the conveyance unit, a heating unit provided downstream of the printhead with respect to a conveyance direction of the print medium and configured to heat the print medium on which the image is printed by the printhead, and a correction unit provided downstream of the heating unit with respect to the conveyance direction and configured to correct curl occurring in the print medium. The apparatus controls to delay, between the heating unit and the correction unit, the conveyance of the print medium heated by the heating unit.

24 Claims, 15 Drawing Sheets

CONVEYANCE DIRECTION
v
HALF DRY STATE
COLORING MATERIAL ADHESION OCCURRENCE
NO COLORING MATERIAL ADHESION OCCURRENCE
LP
L
t = t1
t = t2
t = t1+t3
t = t2+t3
t
50
51
56
60
61
62

PRINTING APPARATUS AND CONTROL METHOD THEREFOR

BACKGROUND OF THE INVENTION

Field of the Invention

The present invention relates to a printing apparatus and a control method therefor, and particularly to, for example, a power suppression technique for a printing apparatus mounted with an inkjet printhead.

Description of the Related Art

Some of conventional inkjet printing apparatuses include a mechanism of drying ink discharged from a printhead to a print medium (for example, print paper). For example, Japanese Patent Laid-Open No. 2009-012414 discloses an image forming apparatus that includes, as a unit for drying ink printed on a print medium, heating rollers capable of contacting the print medium and being separated from the print medium, and a carbon heater or a halogen heater for drying ink without contacting the print medium. According to Japanese Patent Laid-Open No. 2009-012414, ink discharged to the print medium is dried by heating by controlling the operations of the heating rollers, the carbon heater or halogen heater, and the like.

However, in the conventional example, since conveyance rollers are arranged on the downstream side of the arrangement positions of the heating rollers with respect to the conveyance direction of the print medium, if the print medium enters the nip portion of the conveyance rollers in a half dry state, an ink coloring material may adhere to the conveyance roller.

This point will be described with reference to a drawing.

FIG. 15 is a view showing a state in which an image undergoes thermal fixing by a thermal fixing unit and a print medium in the half dry state enters the conveyance rollers.

If high-duty printing is executed, an ink amount discharged per unit area of the print medium is large. In this case, even if the print medium on which an image is printed by discharging ink from the printhead undergoes thermal fixing by the thermal fixing unit, the print medium is output from the thermal fixing unit not in a state in which moisture of the ink completely evaporates but in the half dry state, as shown in FIG. 15. Then, the print medium is conveyed to the conveyance rollers forming the nip portion by an elastic roller and a metallic roller. At this time, if the print medium is in the half dry state, part of the coloring material of the ink discharged to the print medium peels off from the print medium to adhere to the metallic roller in the nip portion.

As a result, the density of the printed image decreases or the image blurs, and thus the quality of the printed image deteriorates. In addition, the ink adhering to the metallic roller may adhere to a following print medium, thereby influencing the quality of a following printed image.

SUMMARY OF THE INVENTION

Accordingly, the present invention is conceived as a response to the above-described disadvantages of the conventional art.

For example, a printing apparatus and a control method therefor according to this this invention are capable of satisfactorily drying a print medium on which an ink image is printed, and outputting a high-quality image.

According to one aspect of the present invention, there is provided a printing apparatus comprising: a conveyance unit configured to convey a print medium; a printhead configured to print an image by discharging ink to the print medium conveyed by the conveyance unit; a heating unit provided on a downstream of the printhead with respect to a conveyance direction of the print medium and configured to heat the print medium on which the image is printed by the printhead; a correction unit provided on a downstream of the heating unit with respect to the conveyance direction and configured to correct curl occurring in the print medium; and a control unit configured to control to delay, between the heating unit and the correction unit, the conveyance of the print medium heated by the heating unit.

According to another aspect of the present invention, there is provided a control method for a printing apparatus including a conveyance unit configured to convey a print medium, a printhead configured to print an image by discharging ink to the print medium conveyed by the conveyance unit, a heating unit provided on a downstream of the printhead with respect to a conveyance direction of the print medium and configured to heat the print medium on which the image is printed by the printhead, and a correction unit provided on a downstream of the heating unit with respect to the conveyance direction and configured to correct curl occurring in the print medium, the method comprising controlling to delay, between the heating unit and the correction unit, the conveyance of the print medium heated by the heating unit.

The invention is particularly advantageous since it is possible to output a high-quality printed image which does not blur or decrease in density.

Further features of the present invention will become apparent from the following description of exemplary embodiments (with reference to the attached drawings).

DESCRIPTION OF THE EMBODIMENTS

Figure 1:
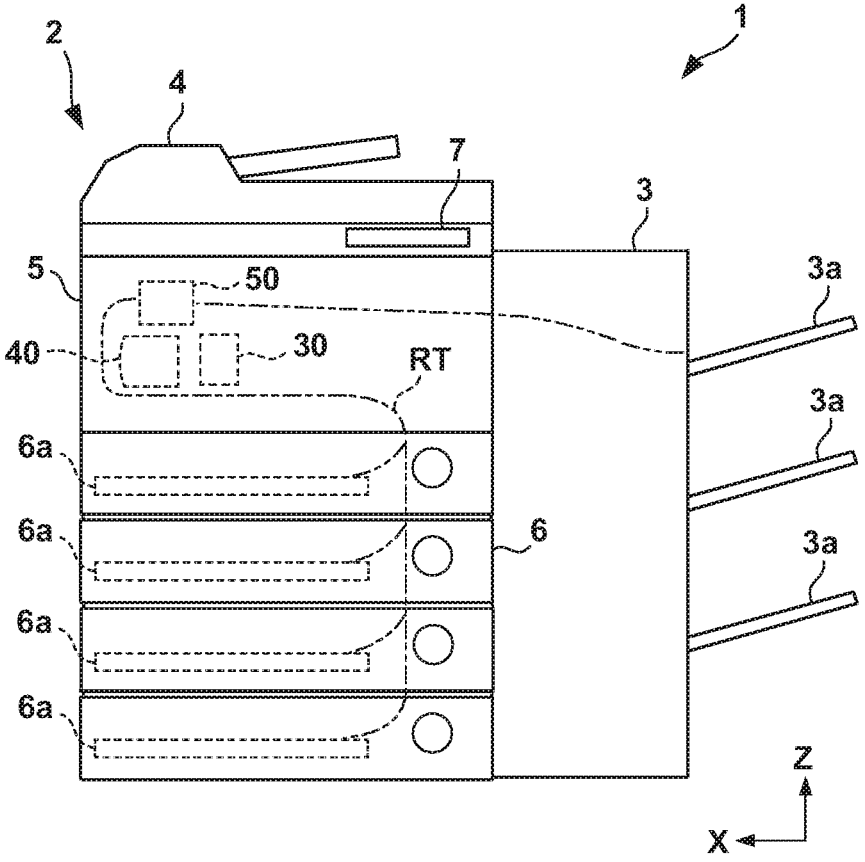
FIG. 1 is a front view of a printing system.

Exemplary embodiments of the present invention will now be described in detail in accordance with the accompanying drawings. It should be noted that the following embodiments are not intended to limit the scope of the appended claims. A plurality of features are described in the embodiments. Not all the plurality of features are necessarily essential to the present invention, and the plurality of features may arbitrarily be combined. In addition, the same reference numerals denote the same or similar parts throughout the accompanying drawings, and a repetitive description will be omitted.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The processing of ink includes, for example, solidifying or insolubilizing a coloring agent contained in ink applied to the print medium.

Further, the term "nozzle" means an ink orifice or a liquid channel communicating with it, unless otherwise specified. A "print element" is provided in correspondence to an orifice, and used to mean an element for generating energy used to discharge ink. For example, the print element may be provided in a position opposite to the orifice.

An element substrate for a printhead (head substrate) used below means not merely a base made of a silicon semiconductor, but an arrangement in which elements, wirings, and the like are arranged.

Further, "on the substrate" means not merely "on an element substrate", but even "on the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Arrangement of Printing System>

FIG. 1 is a front view of a printing system 1 according to an embodiment of the present invention. In the drawings including FIG. 1, arrows X and Y indicate a horizontal direction and a depth direction, respectively, which are perpendicular to each other. An arrow Z indicates a vertical direction.

The printing system 1 includes a main body apparatus 2 and a post processing apparatus 3. The main body apparatus 2 according to this embodiment is an apparatus forming a multi-function peripheral, and has a copy function, a scanner function, and a printer function. The main body apparatus 2 includes a reading apparatus 4, a printing apparatus 5, and a feeding apparatus 6, and an operation unit 7 is provided in the front portion of the main body apparatus 2. The operation unit 7 serves as an input/output interface with a user, and includes, for example, hard keys and a display unit or a touch panel that accepts input from the user and displays information, and also includes an output unit such as a voice generator.

The reading apparatus 4 includes an ADF (Automatic Document Feeder), and conveys stacked documents and reads document images. The feeding apparatus 6 is an apparatus that feeds a print medium to the printing apparatus 5. In this embodiment, the print medium is a sheet such as paper or a film, and is particularly a cut sheet. The print medium may be referred to as a sheet hereinafter. The feeding apparatus 6 includes a plurality of cassettes 6*a* on which sheets are stacked, and a feeding mechanism (not shown) that feeds a sheet from the cassette 6*a* to the printing apparatus 5 on a conveyance path RT.

The printing apparatus 5 prints an image on the sheet. The printing apparatus 5 includes a printing unit 30 that prints an image by discharging ink to a sheet, and a first drying acceleration unit 40 and a second drying acceleration unit 50 that accelerate drying of the sheet. Details of the printing apparatus 5 will be described later.

The post processing apparatus 3 serves as a finisher (sheet processing apparatus) that is separably attached to a side portion of the main body apparatus 2 as an optional apparatus and performs post processing of the sheet. The post processing includes, for example, a stacking processing of stacking, on a tray 3*a*, a sheet discharged from the printing apparatus 5, and a sort processing of taking in a plurality of sheets discharged from the printing apparatus 5 and aligning and bundling them. The post processing can further include stapling processing of binding bundled sheets by staplers, binding processing, and punching processing.

<Arrangement of Printing Apparatus>

Figure 2:
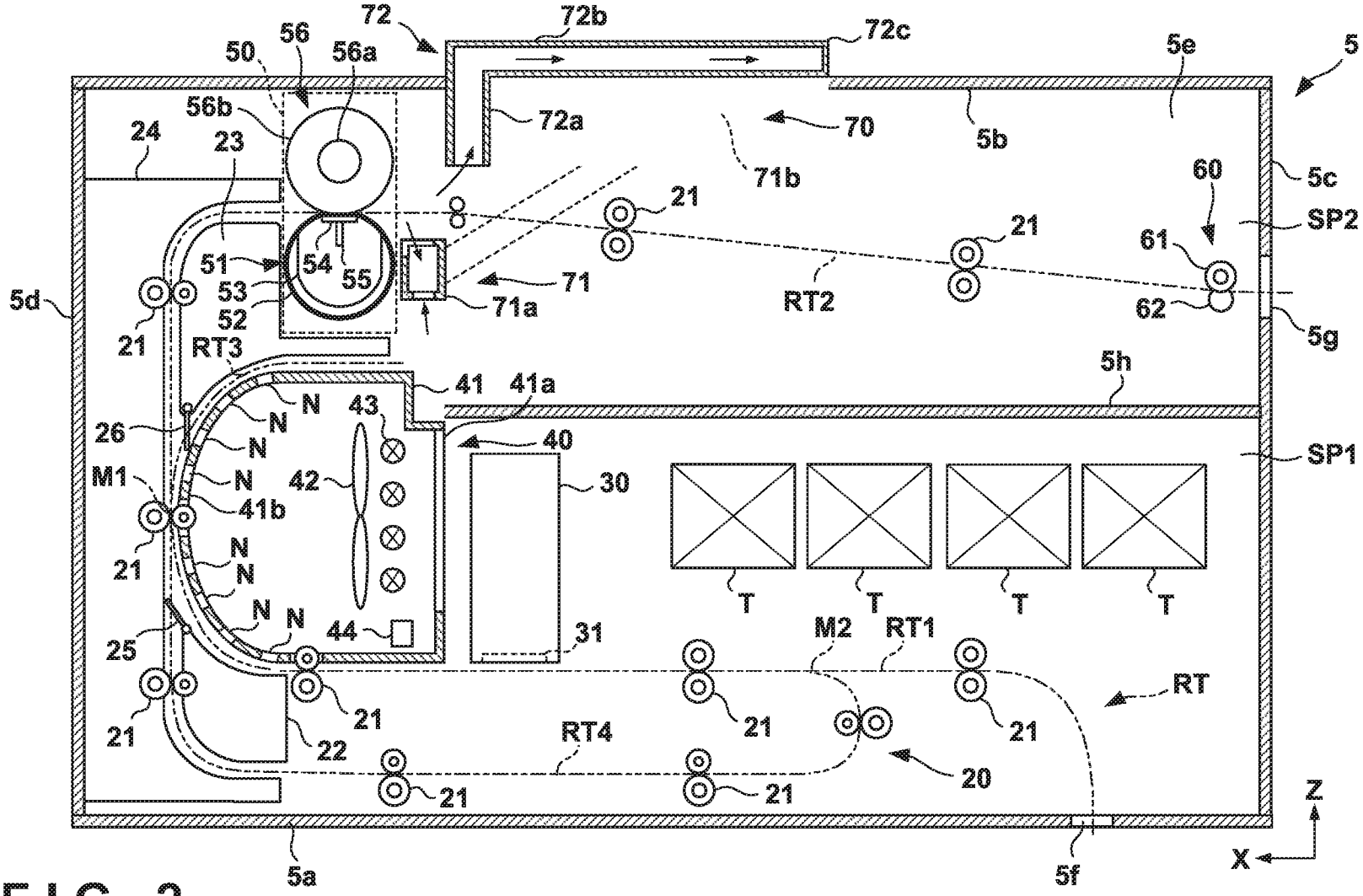
FIG. 2 is a schematic view of a printing apparatus.

FIG. 2 is an explanatory view showing the internal arrangement of the printing apparatus 5. The printing apparatus 5 includes, as a frame for supporting the internal mechanism, a bottom wall portion 5*a*, an upper wall portion 5*b*, a right wall portion 5*c*, a left wall portion 5*d*, and a back wall portion 5*e*. These wall portions define the internal space of the printing apparatus 5. The internal space of the printing apparatus 5 is divided into a lower space SP1 and an upper space SP2 by a partition wall 5*h*. The spaces SP1 and SP2 are not hermetically divided, and communicate with each other.

The bottom wall portion 5*a* includes an opening 5*f* through which a sheet fed from the feeding apparatus 6 passes. The right wall portion 5*c* includes an opening 5*g* through which a sheet passes to be discharged to the post processing apparatus 3. The left wall portion 5*d* and the right wall portion 5*c* may be supported to be opened/closed in a door type for maintenance.

The printing apparatus 5 includes a conveyance unit 20, the printing unit 30, the first drying acceleration unit 40, the second drying acceleration unit 50, a correction unit 60, and an exhaust unit 70.

<Conveyance Unit>

The conveyance unit 20 is a mechanism that conveys a sheet along the conveyance path RT. In this embodiment, the conveyance path RT is a path which has the opening 5*f* as an upstream end and the opening 5*g* as a downstream end and on which the sheet is conveyed. The conveyance path RT includes main paths RT1 and RT2, a switch-back path RT3, and an inverting path RT4. The main paths RT1 and RT2 are paths from the opening 5*f* to the opening 5*g* via an intermediate point M1. The main path RT1 is a path from the opening 5*f* to the intermediate point M1, and the main path RT2 is a path from the intermediate point M1 to the opening 5*g*. The main paths RT1 and RT2 are paths on which the sheet is conveyed leftward→upward→rightward, and the sheet passes through the printing unit 30→first drying acceleration unit 40→second drying acceleration unit 50→correction unit 60. For one-sided print of printing on only one surface of the sheet, the sheet is conveyed through the main paths RT1 and RT2.

The switch-back path RT3 and the inverting path RT4 are paths on which the sheet is conveyed after printing on one surface for double-sided print of printing on both surfaces of the sheet. The switch-back path RT3 forms a path from the intermediate point M1, which is different from the main path RT2. The inverting path RT4 is a path from the intermediate point M1 to a midway joining point M2 on the main path RT1. The sheet is inverted via the inverting path RT4, and is returned to the main path RT1 again.

When referring to the downstream side and the upstream side in the following description, the conveyance direction of the sheet on the conveyance path RT is set as a reference.

The conveyance unit 20 includes a driving mechanism that applies a conveying force to the sheet, and a guide that guides conveyance of the sheet along the conveyance path RT, and FIG. 2 shows part of the conveyance unit 20. The driving mechanism includes a plurality of conveyance rollers 21 driven by a driving source such as a motor. For each conveyance roller 21, a driven roller or a spur is arranged to face it. The sheet is conveyed while being nipped between each conveyance roller 21 and its corresponding driven roller or spur. The spur is arranged to contact a printing surface in a region on the downstream side with respect to the printing unit 30 in order to maintain the quality of a printed image. The guide includes guide members 22 to 24. The guide member 24 is supported by the left wall portion 5*d*. Part of the conveyance path RT is formed between the guide members 23 and 24 and part of the main path RT1 is formed between the guide members 22 and 24.

The conveyance unit 20 includes path switching units 25 and 26. The path switching units 25 and 26 are units that switch the guiding path of the sheet, and are operated by a driving source such as an electromagnetic solenoid or a motor. For one-sided print, the path switching units 25 and 26 guide the sheet from the main path RT1 to the main path RT2. For double-sided print, the path switching units 25 and 26 guide the sheet from the main path RT1 to the switch-back path RT3, and guide the switched-back sheet to the inverting path RT4.

Figure 3:
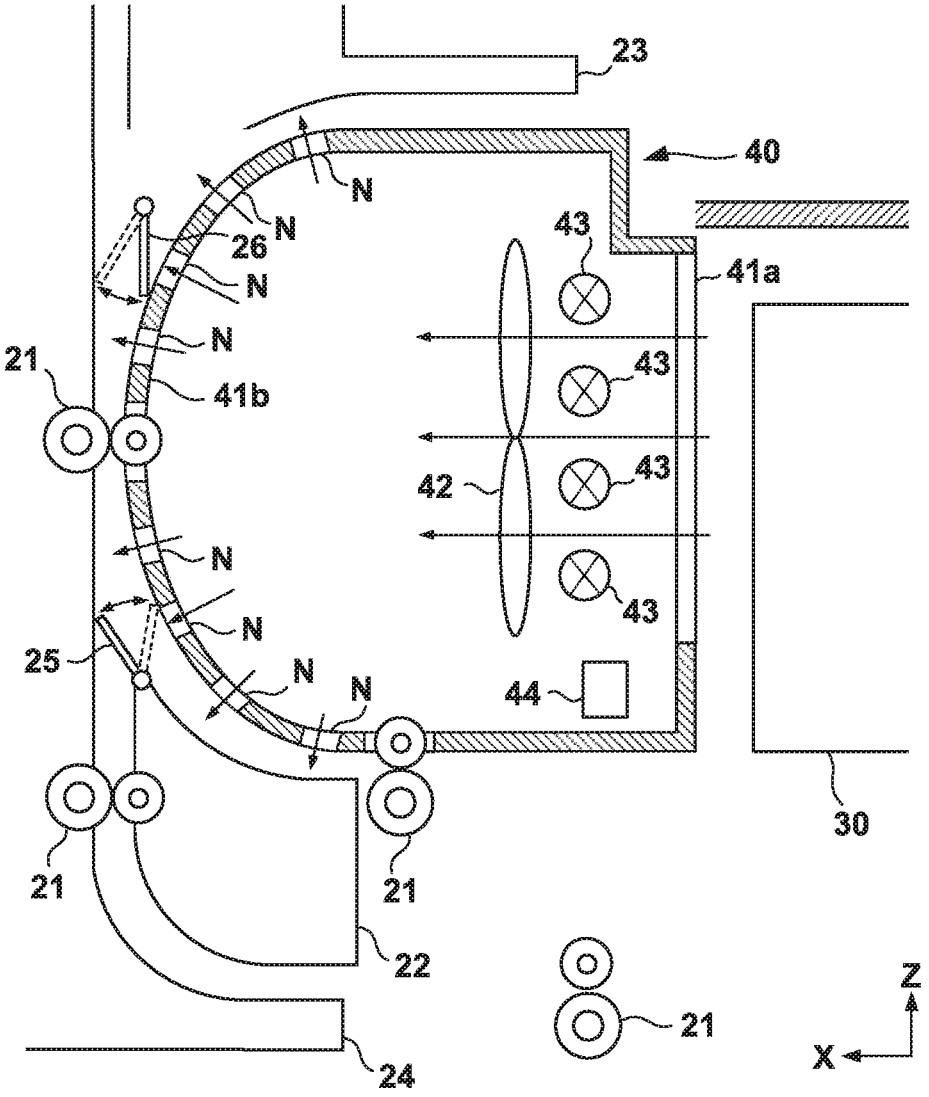
FIG. 3 is an explanatory view of a drying acceleration unit.

FIG. 3 shows the path switching mode of the path switching units 25 and 26. The path switching units 25 and 26 each include a pivotable flap, and switch the path by the positions of the flaps. The positions indicated by solid lines are those for one-sided print, and the positions indicated by broken lines are those for double-sided print.

<Printing Unit>

Referring back to FIG. 2, the printing unit 30 includes printheads 31, and each printhead 31 is an inkjet head that forms an image (ink image) by discharging ink to a sheet. Inks to be discharged by the printheads 31 are reserved in a plurality of ink reservoirs T. The ink reservoirs T are provided for the respective kinds of inks. The kinds of inks are, for example, yellow, magenta, cyan, and black as kinds of colors.

The printheads 31 are provided for the respective kinds of inks. In this embodiment, each printhead 31 is a full-line head extended in the Y direction, and nozzles are arrayed within a range where they cover the width of an image printing area of a sheet having a usable maximum size. Each printhead includes a lower surface facing the sheet via a minute gap (for example, several mm), and the lower surface forms an ink discharge surface with the opened nozzle.

Each nozzle includes a discharge element. The discharge element is, for example, an element that generates a pressure in the nozzle and discharges ink in the nozzle, and the technique of a known inkjet head is applicable. Examples of the discharge element are an element that discharges ink by causing film boiling in ink with an electrothermal transducer and forming a bubble, an element that discharges ink by an electromechanical transducer, and an element that discharges ink by using static electricity. The discharge element that uses the electrothermal transducer can be used to perform high-speed and high-density printing.

Note that the printing unit 30 may be a serial-type printing unit in which printheads mounted on a carriage execute printing by reciprocally moving in the width direction of a sheet. The number of kinds of discharged inks may be one; for example, only black ink may be discharged. As the print mode of the printing unit 30, a print mode of using a single ink or a print mode of using a plurality of kinds of inks can be selected. Each ink may mainly contain a coloring material (dye or pigment) and a solvent component. As a solvent component, a water-based material can be used. As a dye, for example, a water-soluble dye represented by a direct dye, an acid dye, a basic dye, a reactive dye, an edible pigment, or the like is preferable. However, any dye may be used as long as an image that satisfies a fixing property, color development, sharpness, stability, light resistance, and other required properties in combination of the print medium is obtained. As a pigment, carbon black or the like is preferable. Any of a method using a pigment and a dispersant, a method using a self-dispersion type pigment, and a method of performing microencapsulation can be used. Furthermore, ink can be used by adding, as appropriate, various additives such as a solvent component, a solubilizer, a viscosity modifier, a surfactant, a surface tension regulator, a pH adjuster, and a resistivity modifier.

<Drying Acceleration Unit>

A sheet on which an image has been printed by the printing unit 30 may be expanded due to the liquid of the ink, and may be waved. Such sheet causes a paper jam in the printing apparatus 5 or degrades stackability/alignment in the post processing apparatus 3. By accelerating drying of the sheet, it is possible to suppress expansion of the sheet caused by the liquid of the ink. The printing apparatus 5 according to this embodiment includes the plurality of drying acceleration units, that is, the first drying acceleration unit 40 and the second drying acceleration unit 50 of different sheet drying methods.

The first drying acceleration unit 40 is a unit that is arranged on the downstream side with respect to the printing unit 30 and accelerates drying of the sheet by blowing warm air air at a temperature of 30° C. to 100° C.) to the sheet without contacting the sheet. The structure of the first drying acceleration unit 40 will be described with reference to FIGS. 2 and 3. 40 will be described with reference to FIGS. 2 and 3.

The first drying acceleration unit 40 includes a hollow body 41 that defines the internal space, and a fan 42 and heating elements 43 all of which are arranged in the hollow body 41. The hollow body 41 includes an air intake port 41*a* in a right portion. A wall portion 41*b* that forms the left portion of the hollow body 41 is a guide wall portion also serving as a sheet conveyance guide, and is extended in the Y direction to cover the width of a sheet having the maximum size. The guide wall portion 41*b* has a C-shaped sectional shape (a section on an X-Z plane), and includes a wall surface facing the guide members 22 to 24. Part of the conveyance path RT is formed between the wall surface and the guide members 22 to 24, and the intermediate point M1 is also set. In the guide wall portion 41*b*, a number of warm air blowing holes N communicating with the internal space of the hollow body 41 are formed.

The fan 42 is an electric fan that uses a motor as a driving source, and is, for example, a sirocco fan. The fan 42 introduces air from the air intake port 41*a* into the hollow body 41. The pressure in the hollow body 41 increases by the introduced air, and the air in the hollow body 41 is blown out of the hollow body 41 from the blowing holes N. One fan 42 may be provided or a plurality of fans 42 may be juxtaposed in the Y direction.

The heating elements 43 heat the air introduced by the fan 42 from the air intake port 41*a* into the hollow body 41. In this embodiment, each heating element 43 is a rod-like heating element such as an infrared lamp heater, and is extended in the Y direction. The plurality of heating elements 43 are arrayed in the Z direction. The plurality of heating elements 43 are arranged between the fan 42 and the air intake port 41*a*, and the air introduced from the air intake port 41*a* into the hollow body 41 is heated when it passes through the heating elements 43. A temperature sensor 44 is provided in the first drying acceleration unit 40, and driving of the heating elements 43 is controlled in accordance with the detection result of the temperature sensor 44.

With this arrangement, the first drying acceleration unit 40 blows warm air from the blowing holes N, as indicated by an airflow represented by arrows in FIG. 3. This can heat the sheet passing through the conveyance path RT, and promote evaporation of a liquid contained in the ink image on the sheet, thereby accelerating drying of the sheet.

The second drying acceleration unit 50 is a thermal fixing unit that is arranged on the downstream side with respect to the first drying acceleration unit 40 and accelerates drying of the sheet by heating the sheet in contact with the image printing surface of the sheet. The structure of the second drying acceleration unit 50 will be described with reference to FIG. 2.

The second drying acceleration unit 50 includes a heater 51 and a roller 56, which are extended in the Y direction to cover the width of a sheet having the maximum size. The heater 51 includes a support member 53 that supports a heating element 54. The heating element 54 is, for example, a ceramic heater, and is extended in the Y direction. The temperature of the heating element 54 is detected by a temperature sensor 55 represented by a thermistor, and driving of the heating element 54 is controlled based on a detection result.

The support member 53 also supports a film 52. The film 52 is formed in a cylindrical shape and extended in the Y direction. The film 52 is supported by the support member 53 to be rotatable about the support member 53, and is interposed between the roller 56 and the heating element 54. The film 52 is, for example, a single-layer film or composite layer film having a film thickness of 10 μm (inclusive) to 100 μm (inclusive). When the film 52 is a single-layer film, for example, PTFE, PFA, or FEP is used as a material. When the film 52 is a composite film, for example, it is a film with a layer structure that covers or coats a layer of polyimide, polyamide-imide, PEEK, PES, PPS, or the like with PTFE, PFA, FEP, or the like.

Note that the arrangement of the heater 51 is not limited to this, and may have, for example, a structure that includes a heating element such as a halogen heater in a hollow metal core and covers the periphery of the core with an elastic body such as a silicone rubber.

The roller 56 is formed by covering the periphery of a core 56*a* with an elastic body 56*b* such as a silicone rubber. The roller 56 is pressed against the heater 51 by a predetermined pressing force, and the roller 56 and the heater 51 form a nip portion. The roller 56 is rotated using a motor as a driving source, and the film 52 rotates together with the roller 56. With this arrangement, the sheet is heated while being conveyed in the nip portion, thereby making it possible to accelerate drying of the sheet.

In this embodiment, the first drying acceleration unit 40 and the second drying acceleration unit 50 dry the sheet in two stages. However, only one of the drying acceleration units may be provided.

<Correction Unit>

The correction unit 60 is a mechanism that corrects the curvature (curl in this example) of a sheet. In this embodiment, the correction unit 60 includes a large-diameter driving roller 61 and a small-diameter driven roller 62. The driving roller 61 is a roller obtained by covering the periphery of a core with an elastic body such as a silicone rubber. The driven roller 62 is a metal roller. The driving roller 61 and the driven roller 62 are in press contact with each other. When a sheet passes between the driving roller 61 and the driven roller 62, these rollers can apply a pressure to the sheet to correct the curl of the sheet. The correction unit 60 can apply, to the sheet, a correction force in, for example, an upwardly-convex direction. In this case, the correction unit 60 can correct a sheet having a downwardly-convex curl to a flatter state.

<Exhaust Unit>

The exhaust unit 70 is a unit that exhausts the air in the printing apparatus 5 outside the apparatus. The printing apparatus 5 according to this embodiment includes the first drying acceleration unit 40 and the second drying acceleration unit 50, which raise the temperature in the apparatus. In addition, these units operate to evaporate moisture of ink. When continuously printing on a number of sheets, the humidity in the apparatus may rise. A high humidity causes the sheet to be curved. The conveyance distance of the sheet from the second drying acceleration unit 50 to the opening 5*g* is relatively long, and the sheet is conveyed within the upper space SP2 where water vapor is readily retained. In the space SP2, the sheet may be exposed to a high-humidity atmosphere. The humidity in the apparatus can be lowered when the exhaust unit 70 exhausts the air in the space SP2 outside the apparatus.

Figure 4:
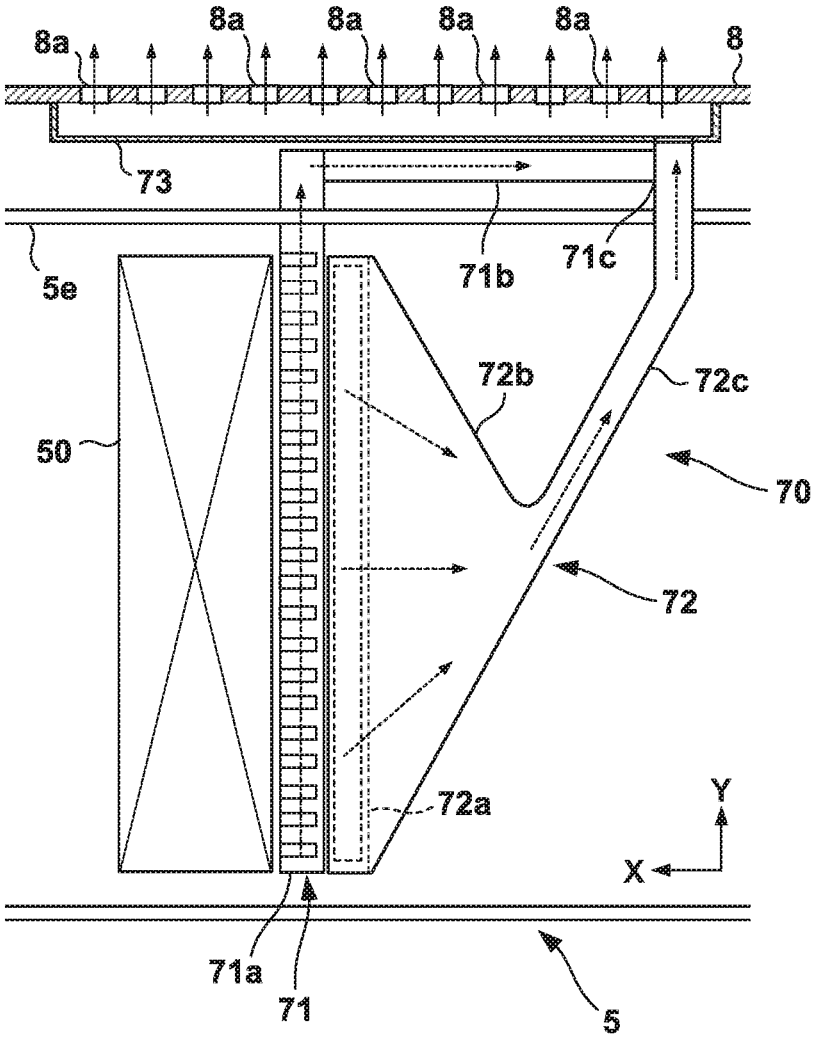
FIG. 4 is an explanatory view of an exhaust unit.

The exhaust unit 70 according to this embodiment has a structure that naturally exhausts the air in the space SP2 by a plurality of exhaust ducts 71 to 73. However, the exhaust unit 70 may forcibly exhaust the air in the apparatus by a fan or the like. The structure of the exhaust unit 70 will be described with reference to FIGS. 2 to 4. FIG. 4 is a plan view showing the periphery of the exhaust unit 70, and does not illustrate the upper wall portion 5*b*.

The exhaust duct 71 is a tube member including an extended portion 71*a* extended in the Y direction and an extended portion 71*b* extended from the far end portion in the Y direction of the extended portion 71*a* to the right side in the X direction. The extended portion 71*a* is extended at a position lower than the main path RT2 near a sheet discharge position in the second drying acceleration unit 50. The extended portion 71*a* is an air intake portion in which a plurality of slits serving as air intake ports are formed in the upper left portion and the bottom portion. For example, air warmed by the second drying acceleration unit 50 can be introduced from the slit in the upper left portion, and warm air blown from the blowing holes N of the first drying acceleration unit 40 can be introduced from the slit in the bottom portion. The extended portion 71*a* is extended across the back wall portion 5*e*, and the far end portion in the Y direction of the extended portion 71*a* and the extended portion 71*b* are located outside (on the far side in the Y direction of) the space SP2. Note that the extended portion 71*a* may be extended at a position above the main path RT2.

The exhaust duct 72 is a tube member including an extended portion 72*a* extended in the Y direction, a collecting portion 72*b* extending rightward from the extended portion 72*a*, and an extended portion 72*c* extended from the right end portion of the collecting portion 72*b* to the far side in the Y direction. The extended portion 72*a* is extended at a position above the main path RT2 near the sheet discharge position in the second drying acceleration unit 50. The bottom portion of the extended portion 72*a* is open to form an air intake port from which, for example, air warmed by the second drying acceleration unit 50 or water vapor in the space SP2 is introduced. The extended portion 72*a* protrudes above the upper wall portion 5*b* across the upper wall portion 5*b*.

The collecting portion 72*b* has, in a planar view, a triangular shape which is wide on the side of the extended portion 72*a*, and the overall collecting portion 72*b* is located above the upper wall portion 5*b*. The collecting portion 72*b* collects, to the central portion in the Y direction in the right end portion, the air introduced into the extended portion 72*a*. The collected air flows into the extended portion 72*c*. The overall extended portion 72*c* is also located above the upper wall portion 5*b*, and the extended portion 72*c* is partially bended and extended on the far side of the back wall portion 5*e*. On the far side of the back wall portion 5*e*, the extended portion 71*b* of the exhaust duct 71 is connected to the extended portion 72*c* of the exhaust duct 72, and the internal spaces of these portions communicate with each other. The extended portion 72*c* is connected to the exhaust duct 73.

The exhaust duct 73 is an exhaust member that is extended in the X direction and is open to the far side in the Y direction. The opening of the exhaust duct 73 faces a cover 8 that forms the exterior of the main body apparatus 2 on the back side. In the cover 8, a number of slits (louver) 8*a* are formed, and the air flowing into the exhaust duct 73 is exhausted out of the apparatus from the back side of the main body apparatus 2 through the slits 8*a*.

<Control Unit>

Figure 5:
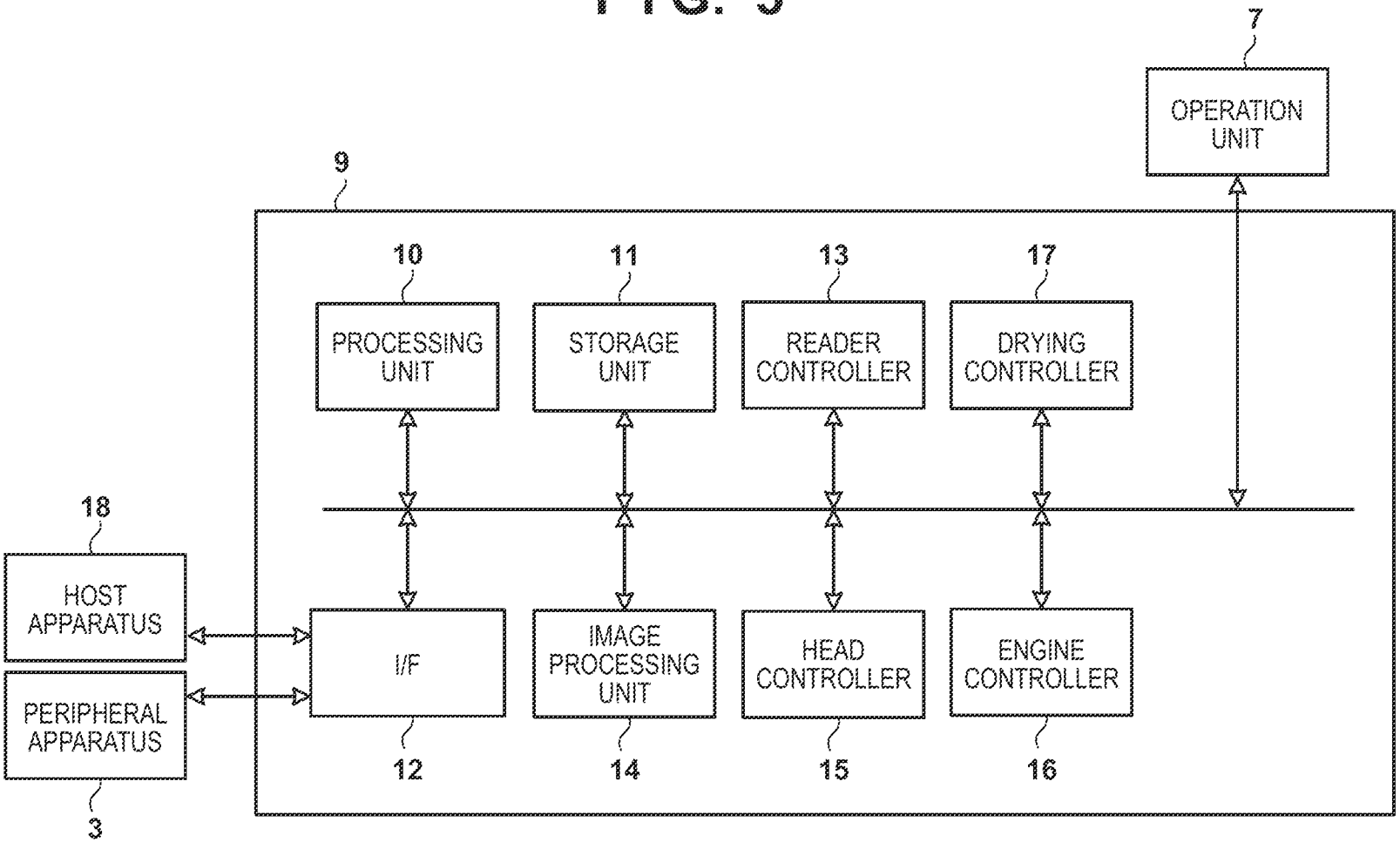
FIG. 5 is a block diagram of a control unit of a main body apparatus.

The control system of the main body apparatus 2 will be described. FIG. 5 is a block diagram of a control unit 9 of the main body apparatus 2. The control unit 9 includes a processing unit 10, a storage unit 11, a reading controller 13, an image processing unit 14, a head controller 15, an engine controller 16, and a drying controller 17. The processing unit 10 is a processor represented by a CPU (Central Processing Unit), and comprehensively controls the operations of the units of the main body apparatus 2. The storage unit 11 is, for example, a storage device such as a ROM or a RAM. The storage unit 11 stores a program to be executed by the processing unit 10, and permanent data (for example, data concerning a sheet type stored in each cassette 6*a*) necessary for various operations of the main body apparatus 2. The storage unit 11 serves as a work area of the processing unit 10 or a temporary storage area of various reception data to store various setting data.

The reading controller 13 controls the reading apparatus 4. The image processing unit 14 performs image processing of image data to be processed by the main body apparatus 2. The color space (for example, YCbCr) of input image data is converted into a standard RGB color space (for example, sRGB). Print data obtained by these image processes is stored in the storage unit 11. The head controller 15 controls driving of the printing unit 30 in accordance with the print data based on a control command received from the processing unit 10. The engine controller 16 controls conveyance of a sheet. The drying controller 17 controls driving of the first drying acceleration unit 40 and the second drying acceleration unit 50. Each of these controllers includes a processor such as a CPU, a storage device such as a RAM or a ROM, and an interface with an external device.

An I/O 12 is an interface (I/F) for connecting the control unit 9 to a host apparatus 18 and the post processing apparatus 3, and is a local I/F or a network I/F. The host apparatus 18 is an apparatus serving as a supply source of image data for causing the printing apparatus 5 to perform a printing operation. The host apparatus 18 may be a general-purpose or dedicated computer, or a dedicated image apparatus including an image reader, such as image capture, a digital camera, or a photo storage.

<Operation Example>

An example of the printing operation of the printing apparatus 5 under the control of the control unit 9 will be described with reference to FIGS. 6 to 9. First, an operation when printing an image on one surface of a sheet will be described with reference to FIGS. 6 and 7. When printing an image on one surface of a sheet, the path switching units 25 and 26 are set at the positions (the positions indicated by solid lines in FIG. 3) for one-sided print. The heating elements 43 of the first drying acceleration unit 40 and the heating element 54 of the second drying acceleration unit 50 are maintained in advance at a predetermined temperature.

Figure 6:
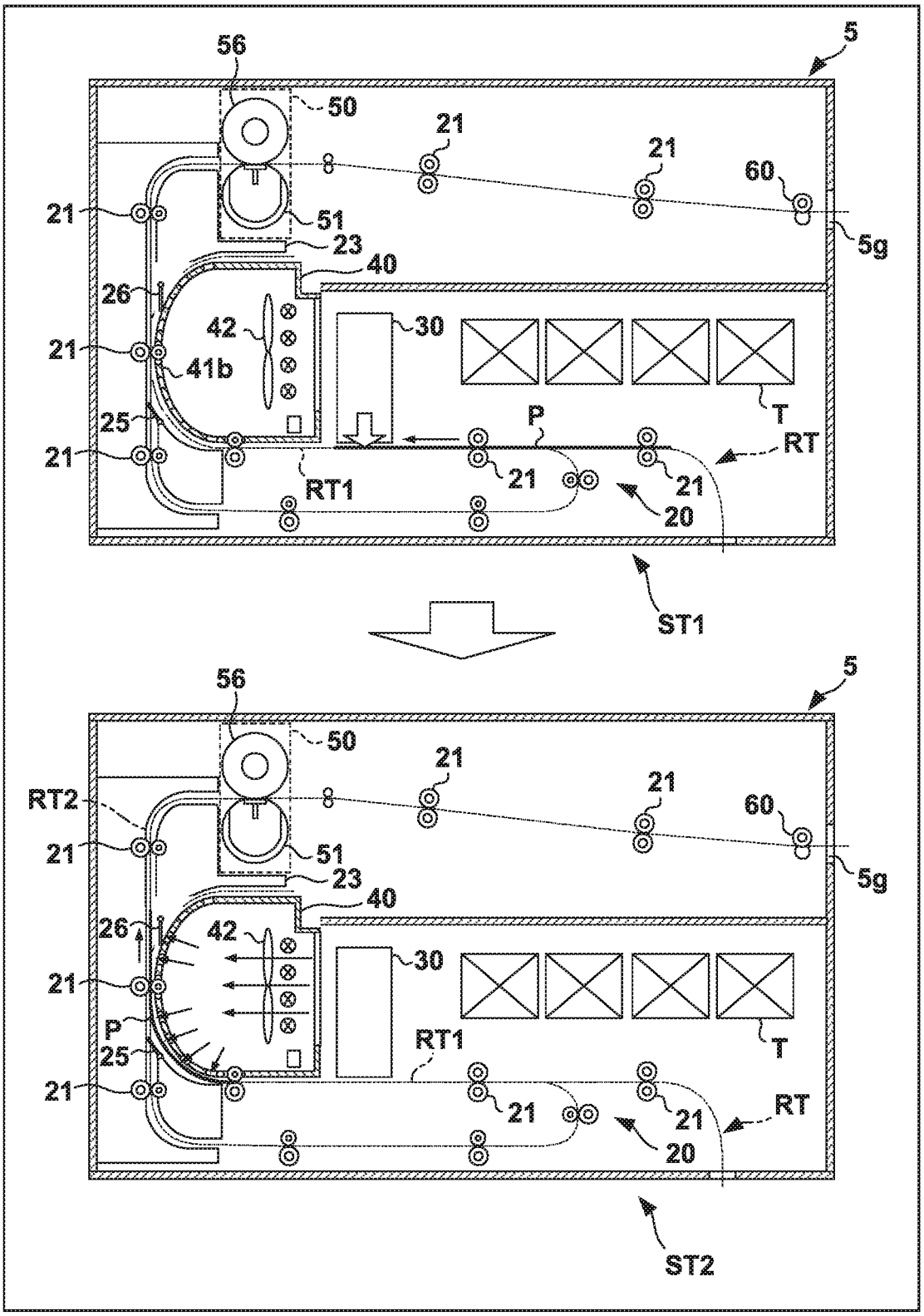
FIG. 6 is an explanatory view of the operation of the printing apparatus shown in FIG. 2.

A state ST1 shown in FIG. 6 indicates a state in which a sheet P fed from the feeding apparatus 6 has been conveyed by the conveyance unit 20 to the printing unit 30 on the main path RT1, and printing by the printing unit 30 has started. The printing unit 30 prints an image by discharging ink to the sheet P as indicated by an arrow. The sheet P is conveyed toward the first drying acceleration unit 40. The first drying acceleration unit 40 starts to operate, and blows warm air to the conveyed sheet P, as indicated by a state ST2 shown in FIG. 6. The warm air accelerates drying of the sheet P wet with ink.

The sheet P is further conveyed toward the second drying acceleration unit 50 on the main path RT2. The second drying acceleration unit 50 starts to operate, the roller 56 rotates, as indicated by a state ST3 shown in FIG. 7, and the sheet P is heated by the heater 51 while being conveyed. Drying of the sheet P is further accelerated.

Figure 7:
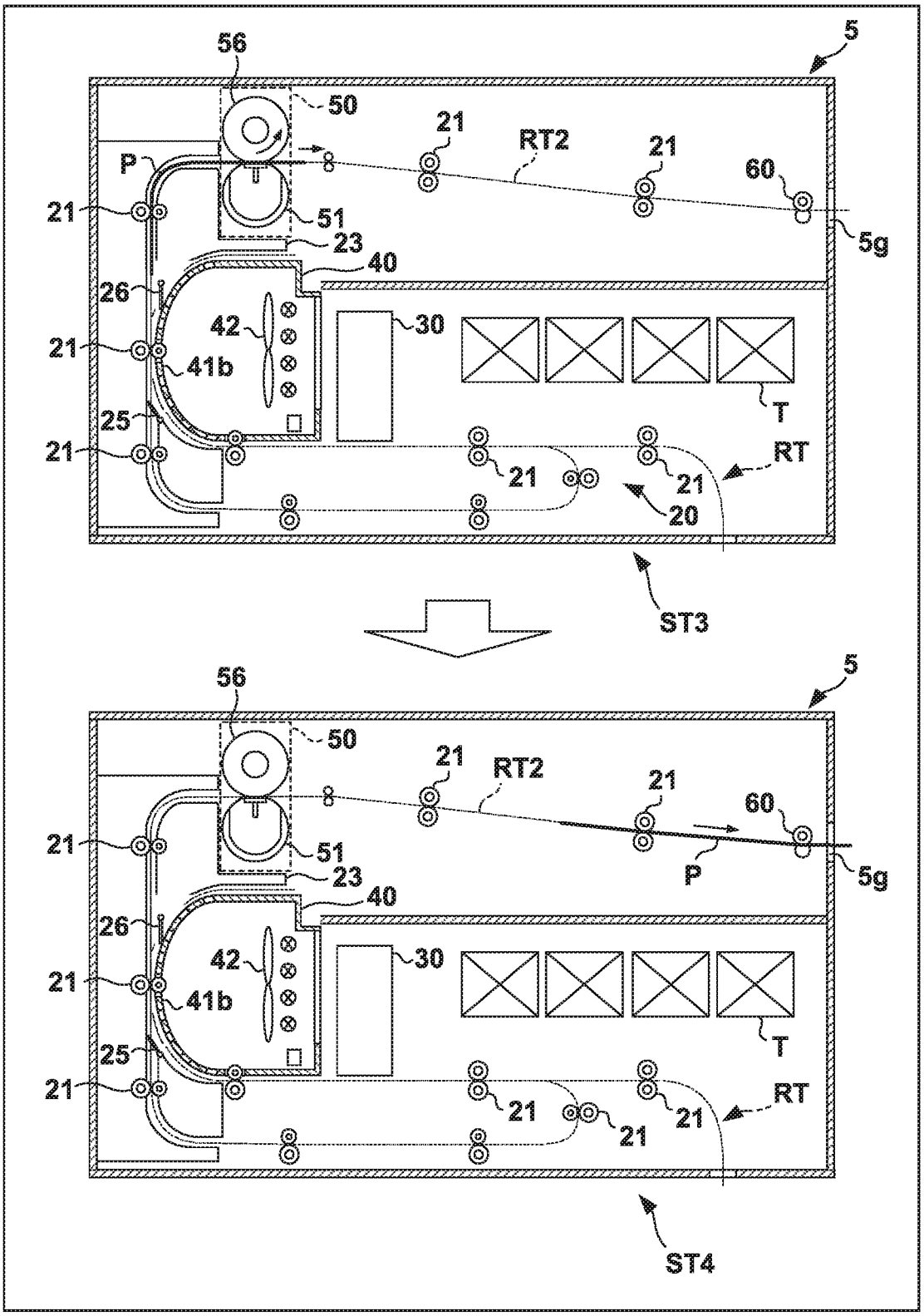
FIG. 7 is an explanatory view of the operation of the printing apparatus shown in FIG. 2.

As indicated by a state ST4 shown in FIG. 7, the sheet P is further conveyed toward the correction unit 60 on the main path RT2. The correction unit 60 starts to operate, and the sheet P is discharged from the opening 5*g* to the post processing apparatus 3 while the curl of the sheet P is corrected.

Figure 8:
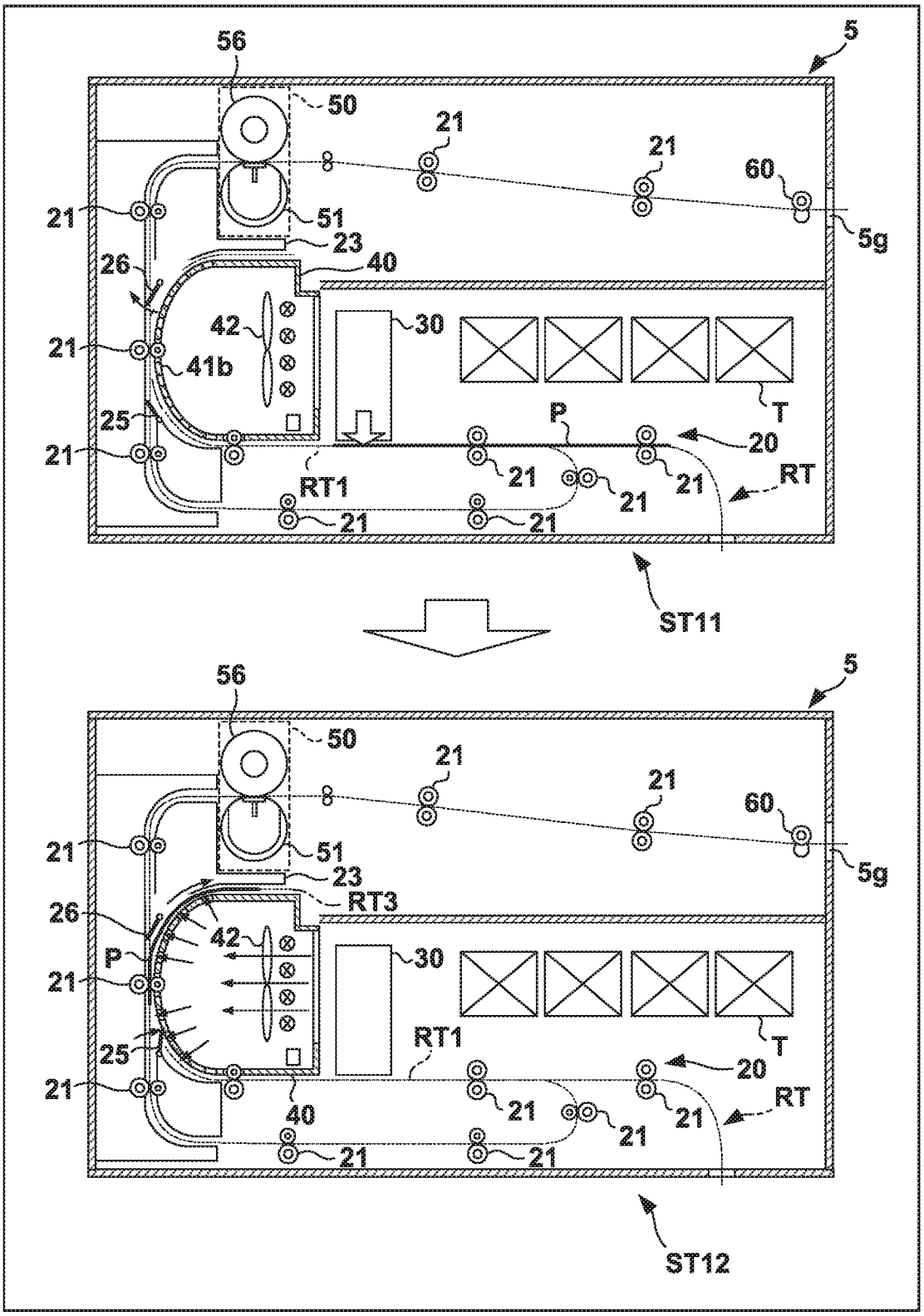
FIG. 8 is an explanatory view of the operation of the printing apparatus shown in FIG. 2.

An operation when printing images on both surfaces of a sheet will be described next with reference to FIGS. 8 and 9. A state ST11 shown in FIG. 8 indicates a state in which the sheet P fed from the feeding apparatus 6 has been conveyed by the conveyance unit 20 to the printing unit 30 on the main path RT1, and the printing unit 30 has started printing. The printing unit 30 prints an image by discharging ink to the front surface of the sheet P, as indicated by an arrow. The path switching unit 26 is set at the position (the position indicated by the broken line in FIG. 3) for double-sided print.

The sheet P is conveyed toward the first drying acceleration unit 40. The first drying acceleration unit 40 starts to operate, and blows warm air to the conveyed sheet P, as indicated by a state ST12 shown in FIG. 8. The warm air accelerates drying of the sheet P wet with ink. The path switching unit 26 guides the sheet P not to be conveyed to the second drying acceleration unit 50 but to be conveyed to the switch-back path RT3. When the trailing edge of the sheet P passes through the position of the path switching unit 25, the path switching unit 25 is set at the position for double-sided print. Subsequently, the conveyance unit 20 conveys the sheet P in a reverse direction on the switch-back path RT3 (switch-back conveyance).

Figure 9:
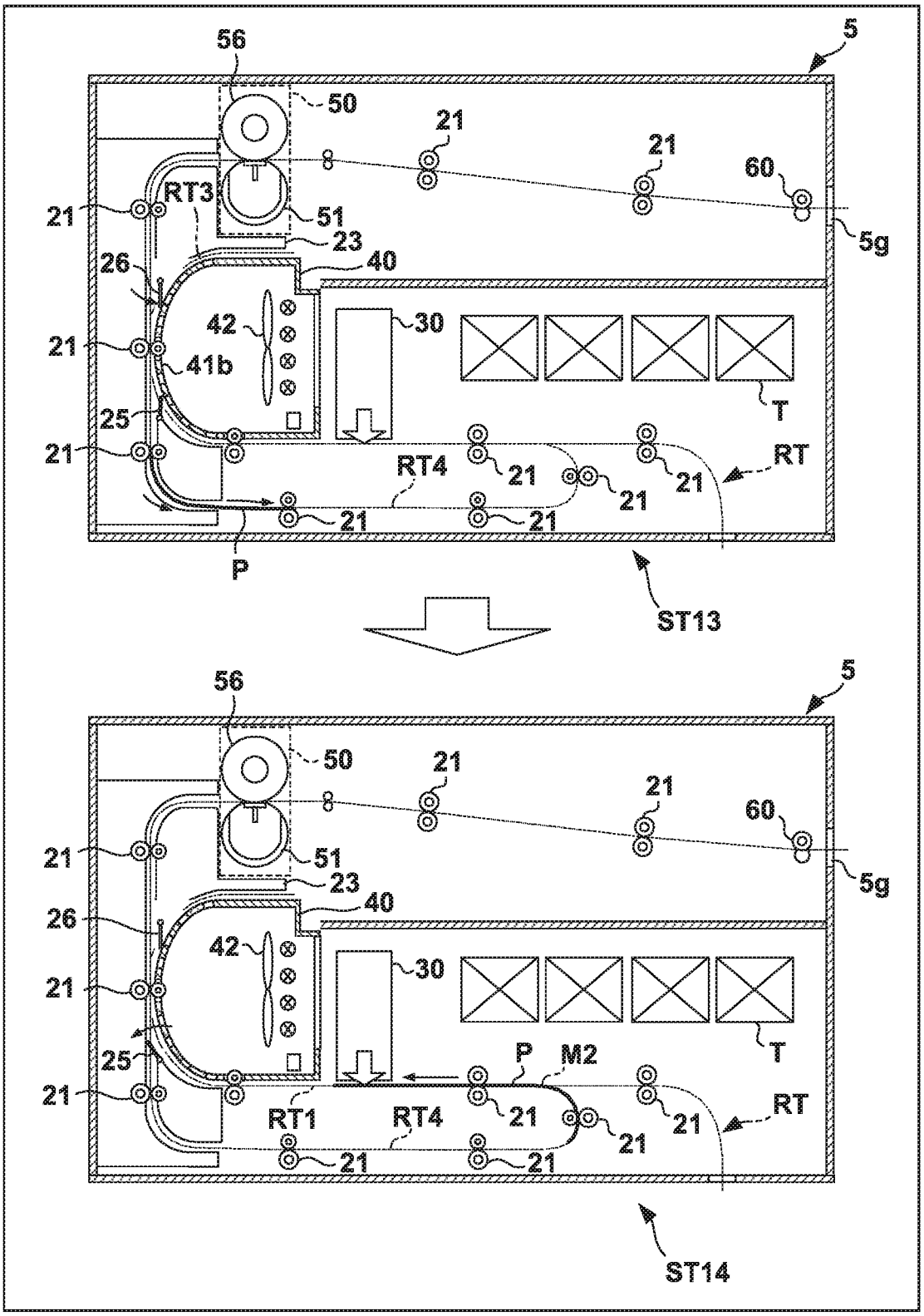
FIG. 9 is an explanatory view of the operation of the printing apparatus shown in FIG. 2.

The path switching unit 25 guides the sheet P to be conveyed to the inverting path RT4, as indicated by a state ST13 shown in FIG. 9. Then, the sheet P is returned to the main path RT1, as indicated by a state ST14 shown in FIG. 9. The path switching unit 25 is set at the position (the position indicated by the solid line in FIG. 3) for one-sided print. The printing unit 30 prints an image by discharging ink to the back surface of the sheet P, as indicated by an arrow. Operations after that are the same as those in the states ST2 to ST4 for one-sided print.

Some embodiments of conveyance control of a print medium after drying the printed image by heating in the printing system with the above arrangement will be described next.

First Embodiment

Figures 10A, 10B:
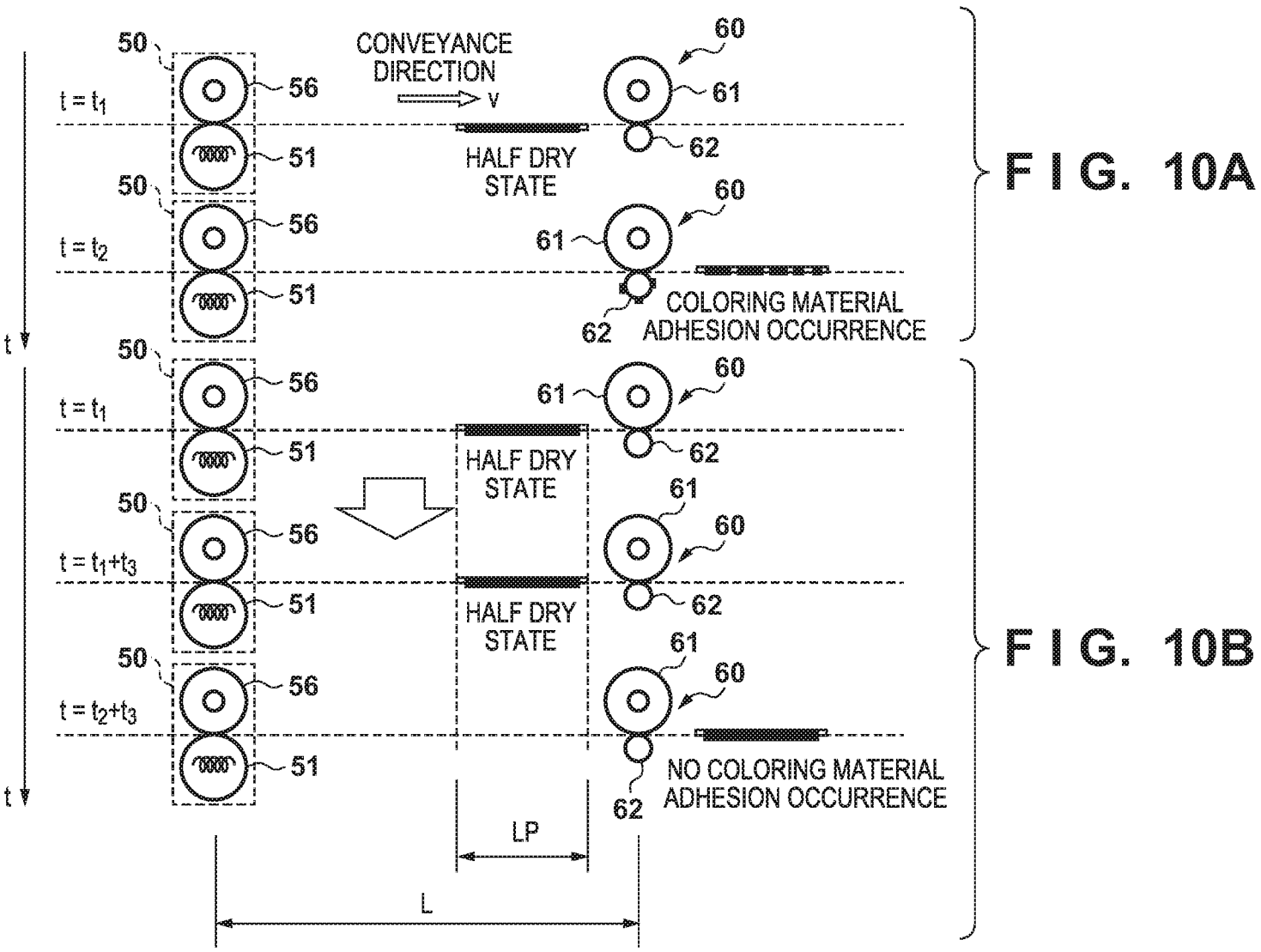
FIGS. 10A and 10B are views schematically explaining a concept of conveyance control of a print medium according to the first embodiment.

FIGS. 10A and 10B are views for schematically explaining a concept of conveyance control of a print medium according to the first embodiment.

FIG. 10A shows a state in which a print medium output from the drying acceleration unit 50 in the half dry state is conveyed directly to the correction unit 60. FIG. 10B shows a state in which the conveyance of a print medium output from the drying acceleration unit 50 in the half dry state is temporarily stopped or decelerated before the correction unit 60. Note that in FIGS. 10A and 10B, the same reference numerals as those described with reference to FIGS. 1 to 9 denote the similar components and a description thereof will be omitted.

In either of the cases shown in FIGS. 10A and 10B, an image of the same printing duty is printed on the print medium, and the print medium is conveyed to the drying acceleration unit 50 to dry the image by heating, and is then conveyed to the correction unit 60.

Furthermore, in each of the arrangements shown in FIGS. 10A and 10B, when L represents the distance between the nip portion of the drying acceleration unit 50 and that of the correction unit 60 and LP represents the length of the print medium with respect to the conveyance direction of the print medium, a relationship of L>LP is satisfied. That is, the correction unit 60 is provided at a distance from the drying acceleration unit 50, which is equal to or longer than the length of the print medium. Therefore, when the trailing edge of the print medium passes through the nip portion of the drying acceleration unit 50 with respect to the conveyance direction of the print medium, the leading edge of the print medium has not reached the nip portion of the correction unit 60, and thus the print medium needs to be further conveyed.

The half dry state basically indicates a state in which moisture of ink applied to the print medium has not evaporated completely. For example, a state in which the print medium in the following state is partially evaporated by the drying acceleration unit 50 is defined as the half dry state. That is, a state in which moisture of the print medium in a state wherein a print resolution is 600 dpi, an ink application amount is 20 ng/unit area, a moisture content in the ink in terms of percentage is 70%, and a moisture content in the ink is 14 (20×0.7) ng/unit area is partially evaporated is defined as the half dry state.

As shown in FIG. 10A, at time $t=t_1$, the trailing edge of the print medium in the half dry state passes through the nip portion of the heater 51 and the roller 56, and the print medium is conveyed at a conveyance speed v without stopping, and reaches the correction unit 60. Furthermore, the print medium is conveyed, and the trailing edge of the print medium passes through the nip portion of the driving roller 61 and the driven roller 62 at time $t=t_2$. In this case, part of an ink coloring material of the print medium in the half dry state adheres to the driven roller 62.

To solve this problem, in this embodiment, as shown in FIG. 10B, when the trailing edge of the print medium in the half dry state passes through the nip portion of the heater 51 and the roller 56 at time $t=t_1$, the conveyance of the print medium is temporarily stopped or the conveyance speed is decelerated. The temporary stop time or the deceleration time of the conveyance is a time until an ink state in which the ink coloring material of the print medium does not adhere to the driven roller 62 when the print medium reaches the correction unit 60 is obtained.

As shown in FIG. 10B, at time $t=t_1$, the trailing edge of the print medium passes through the nip portion of the drying acceleration unit 50. After that, the print medium stands by on the conveyance path between the drying acceleration unit 50 and the correction unit 60 until time $t=t_1+t_3$. After that, when the ink state in which the ink coloring material of the print medium does not adhere to the driven roller 62 is obtained, the conveyance of the print medium is restarted or the print medium is conveyed by returning the conveyance speed to the normal speed v. Then, at time $t=t_2+t_3$, the trailing edge of the print medium passes through the nip portion of the correction unit 60.

Note that as shown in FIG. 2, the plurality of conveyance rollers 21 are provided on the conveyance path between the drying acceleration unit 50 and the correction unit 60. Therefore, by stopping the rotations of these rollers or decreasing the rotation speed, the conveyance of the print medium is temporarily stopped or the conveyance speed is decelerated. The CPU of the processing unit 10 and the engine controller 16 execute these control operations in cooperation with each other.

Therefore, according to the above-described embodiment, since the conveyance of the print medium is controlled to sufficiently dry the print medium in the half dry state before the correction unit existing on the downstream side with respect to the conveyance direction of the print medium, it is possible to prevent the ink coloring material from adhering to the roller of the correction unit.

As described above, by delaying the entry timing of the print medium to the correction unit (decurling roller), a situation in which part of ink discharged to the print medium peels off to decrease the print density or ink blurs is prevented, thereby implementing high-quality printing.

Second Embodiment

In high-duty printing, an ink application amount on the print medium is large, and thus ink permeation into the print medium (for example, a print sheet) is slow. Since the ink application amount is large, the remaining moisture content on the printing surface of the print medium when passing through the heater 51 is large. Thus, when passing through the correction unit (decurling roller) 60, the ink coloring material readily adheres to the driven roller 62. To solve this problem, in the control processing according to the first embodiment, the entry timing of the print medium after drying by heating to the correction unit (decurling roller) is delayed.

With reference to a flowchart, this embodiment will describe an example of changing a delay in entry timing of the print medium after drying by heating to the correction unit (decurling roller) in accordance with the ink application amount on the print medium in addition to the control arrangement according to the first embodiment.

Figure 11:
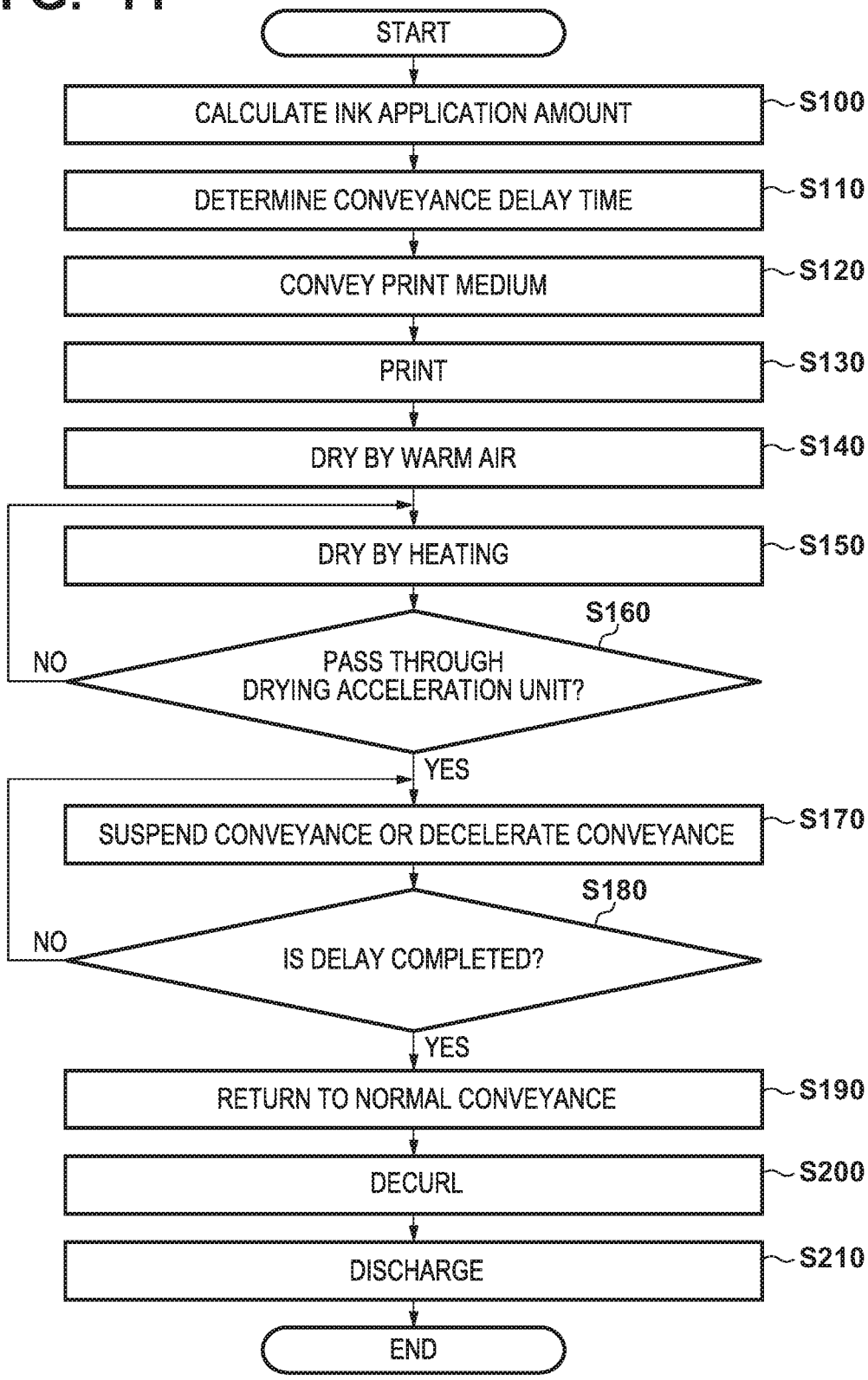
FIG. 11 is a flowchart illustrating conveyance control of a print medium according to the second embodiment.

FIG. 11 is a flowchart illustrating conveyance control of the print medium according to the second embodiment.

Referring to FIG. 11, in step S100, an ink discharge amount (ink application amount) per print medium is calculated based on print data transmitted from the host apparatus 18. More specifically, the ink application amount is calculated by counting the number of ink droplets discharged from the printheads to one print medium. The CPU of the processing unit 10 executes this count processing.

In step S110, based on the ink application amount calculated in step S100, the conveyance delay time of the print medium on the conveyance path between the drying acceleration unit 50 and the correction unit 60 is decided. This decision processing is performed by additionally considering the decrease rate of the density of the print medium when passing through the decurling roller 60 and a condition that the decurling roller 60 is not stained. Note that to increase the processing speed, an LUT (lookup table) indicating the relationship between the ink application amount per print medium and the conveyance delay time of the print medium may be provided, and the CPU may access the LUT to decide the conveyance delay time of the print medium.

In step S120, one sheet-like print medium is picked up from the cassette 6*a* of the feeding apparatus 6 and conveyed to the conveyance path RT. In step S130, the printheads 31 discharge ink to the print medium, thereby printing an image. Furthermore, in step S140, the drying acceleration unit 40 dries, by warm air, the print medium on which the image is printed. In step S150, the drying acceleration unit 50 dries the printed image by heating.

In step S160, it is checked whether the trailing edge of the print medium has passed through the nip portion formed by the heater 51 and the roller 56 of the drying acceleration unit 50 with respect to the conveyance direction of the print medium. While the print medium passes through the nip portion, the drying acceleration unit 50 continues to dry the print medium by heating in step S150. If it is determined that the trailing edge of the print medium has passed through the nip portion of the drying acceleration unit 50, the process advances to step S170.

In step S170, when the print medium is on the conveyance path between the drying acceleration unit 50 and the correction unit 60, the rotations of the conveyance rollers 21 are stopped or the rotation speed is decelerated to temporarily stop (suspend) or decelerate the conveyance of the print medium. By delaying the conveyance of the print medium in this way, the timing at which the print medium enters the decurling roller 60 after passing through the heater 51 is delayed. In step S180, it is checked whether the delay time has reached the conveyance delay time decided in step S110.

If the delay time has not reached the conveyance delay time, the process continues to delay the conveyance in step S170; otherwise, the process advances to step S190, and the print medium is returned to the normal conveyance state. After that, the print medium reaches the decurling roller 60, and curl of the print medium is corrected (decurled) by the correction unit 60 in step S200. Then, in step S210, the print medium is discharged outside the apparatus.

Therefore, according to the above-described embodiment, it is possible to control the conveyance timing of the print medium after drying by heating to the decurling roller based on the ink discharge amount (ink application amount) per print medium. This can convey the print medium to the decurling roller in a state in which it is sufficiently dried, and it is thus possible to prevent the ink coloring material from adhering to the roller of the correction unit.

Third Embodiment

Since, for a print medium with a large basis weight or a print medium with a low ink permeability, ink permeation into the print medium is slow, similar to the case in which the ink application amount is large, an ink coloring material readily adheres to the decurling roller when passing through the decurling roller. In the second embodiment, the conveyance delay time is decided based on the printing duty (that is, the ink discharge amount or ink application amount on the print medium). This embodiment will describe an example of deciding the conveyance delay time in accordance with the type of a print medium. Therefore, in this embodiment, a sensor for discriminating the type of a print medium is provided in the pickup portion of the cassette 6*a* of the feeding apparatus 6 or on the conveyance path to the printheads 31.

The sensor that detects the type of a print medium optically detects properties according to the type based on a spectral reflectance. When detecting a print medium, this sensor detects, by a light receiving element, light obtained when irradiation light from a light emitting element is reflected by the print medium, and discriminates the type of the print medium based on the light amount level of the reflected light. Thus, if the print medium is detected in a stopped state or detected at a very low speed, the light amount level remains unchanged, thereby making it possible to perform correct detection. Note that the arrangement of this sensor is known, and is disclosed in, for example, Japanese Patent Laid-Open No. H09-114267, and a description thereof will be omitted.

Figure 12:
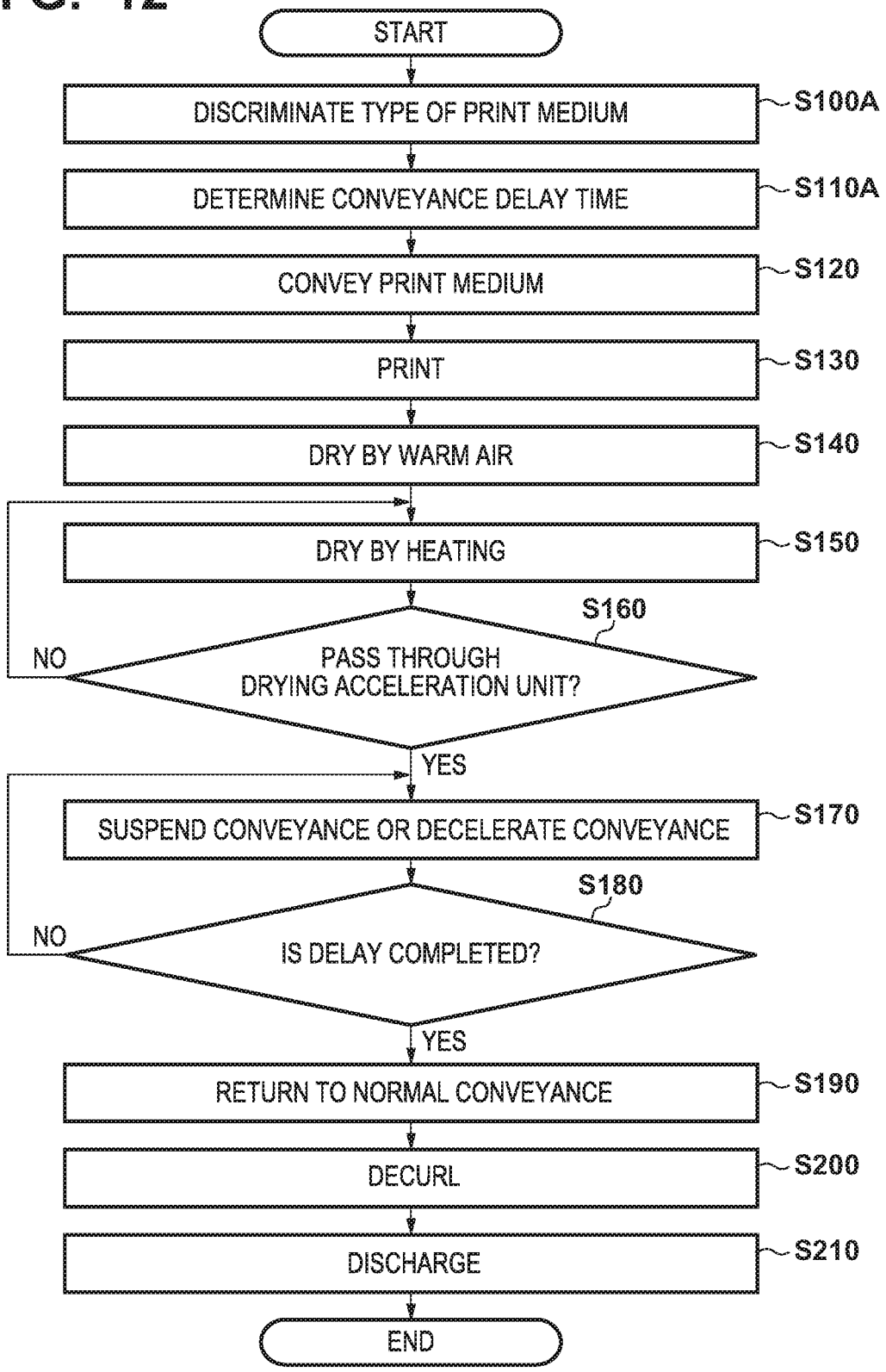
FIG. 12 is a flowchart illustrating conveyance control of a print medium according to the third embodiment.

FIG. 12 is a flowchart illustrating conveyance control of the print medium according to the third embodiment. Note that in FIG. 12, the same step numbers as those described with reference to FIG. 11 denote the same processing steps and a description thereof will be omitted.

Referring to FIG. 12, in step S100A, the sensor discriminates the type of the print medium. In step S110A, the conveyance delay time of the print medium on the conveyance path between the drying acceleration unit 50 and the correction unit 60 is decided based on a discrimination result. This decision processing is performed by additionally considering the decrease rate of the density of the print medium when passing through the decurling roller 60 and a condition that the decurling roller 60 is not stained. Note that to increase the processing speed, an LUT (lookup table) indicating the relationship between the type of a print medium and the conveyance delay time of the print medium may be provided, and the CPU may access the LUT to decide the conveyance delay time of the print medium.

As described in the second embodiment, the processes in steps S120 to S210 are then executed.

Therefore, according to the above-described embodiment, it is possible to control the conveyance timing of the print medium after drying by heating to the decurling roller based on the type of the print medium.

Fourth Embodiment

In the second embodiment, the conveyance delay time is decided based on the printing duty (that is, the ink discharge amount or ink application amount on the print medium). In the third embodiment, the conveyance delay time is decided in accordance with the type of a print medium. Depending on a calorific value applied by the heater 51, the half dry state of a print medium on which an image is dried by heating varies.

In this embodiment, moisture content information of the print medium after the print medium passes through the drying acceleration unit is predicted based on information representing the heating capability of the heating roller (specifications of the heating element) and an ink application amount on the print medium based on print data. Then, the conveyance delay time of the print medium is decided in accordance with the predicted value.

Figure 13:
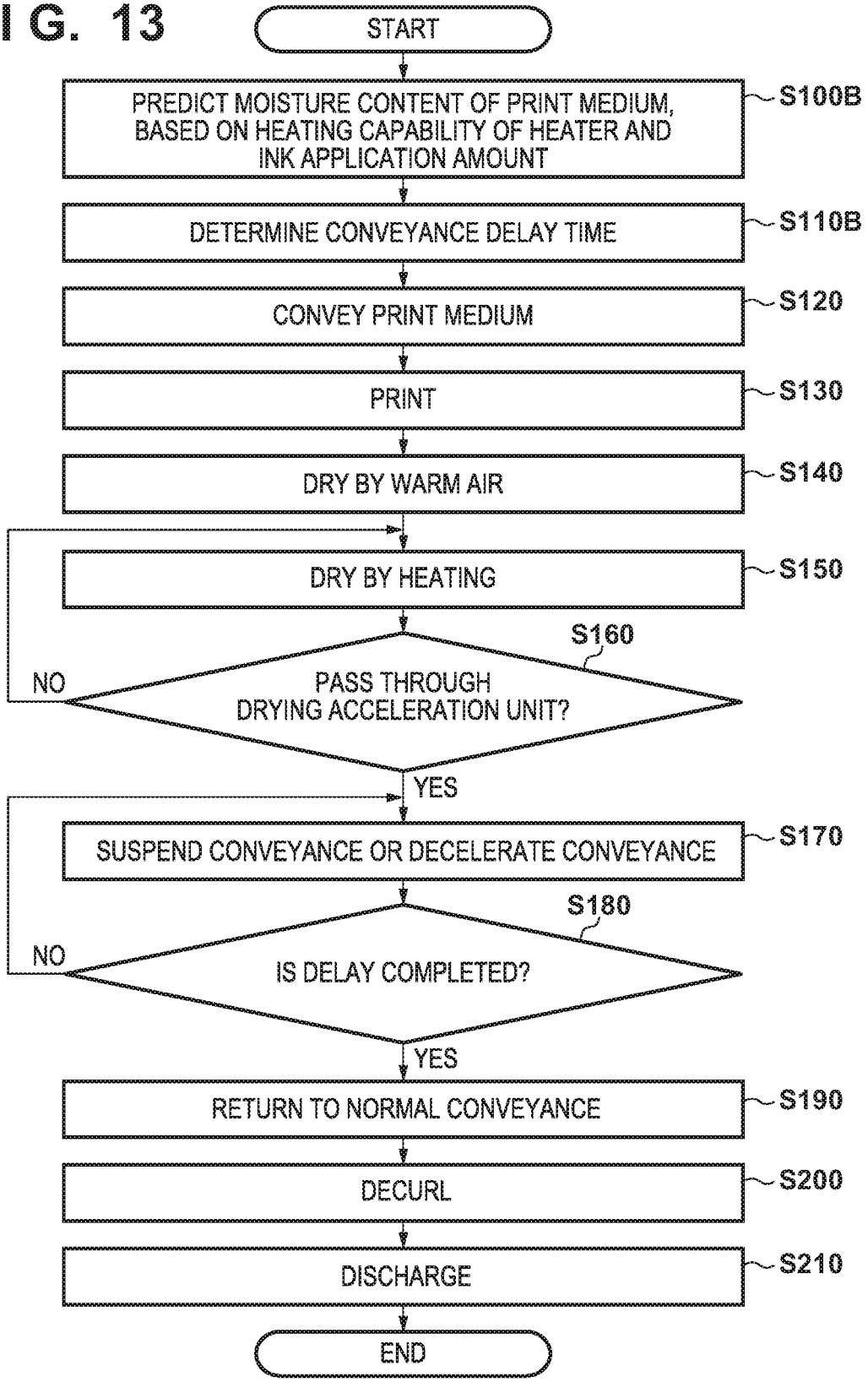
FIG. 13 is a flowchart illustrating conveyance control of a print medium according to the fourth embodiment.

FIG. 13 is a flowchart illustrating conveyance control of the print medium according to the fourth embodiment. Note that in FIG. 13, the same step numbers as those described with reference to FIG. 11 denote the same processing steps and a description thereof will be omitted.

Referring to FIG. 13, in step S100B, the moisture content information of the print medium after passing through the drying acceleration unit is predicted based on the heating capability of the heater 51 and the ink application amount on the print medium based on the print data transmitted from the host apparatus 18.

In step S110B, based on the predicted moisture content information of the print medium, the conveyance delay time of the print medium on the conveyance path between the drying acceleration unit 50 and the correction unit 60 is decided. Note that to increase the processing speed, an LUT (lookup table) indicating the relationship between the moisture content of the print medium and the conveyance delay time of the print medium may be provided, and the CPU may access the LUT to decide the conveyance delay time of the print medium.

As described in the second embodiment, the processes in steps S120 to S210 are then executed.

Therefore, according to the above-described embodiment, it is possible to control the timing of conveyance of the print medium after drying by heating to the decurling roller based on the heating capability of the heater that dries the image on the print medium by heating.

Note that if the heating capability of the heater 51 has a margin, the calorific value by the heater 51 may be increased to make the print medium pass through the decurling roller without setting the conveyance delay time. This can obtain faster print throughput.

Fifth Embodiment

In the second embodiment, the conveyance delay time is decided based on the printing duty (that is, the ink discharge amount or ink application amount on the print medium). In the third embodiment, the conveyance delay time is decided in accordance with the type of a print medium. In the fourth embodiment, the conveyance delay time is decided in accordance with the heating capability of the heater and the ink application amount on the print medium.

If the temperature near the decurling roller 60 is low, the viscosity of applied ink is high, and the speed of permeation into the print medium is low. Thus, the ink coloring material readily adheres to the decurling roller 60. In addition, even if the humidity near the decurling roller 60 is low, the speed of ink permeation into the print medium is low, and thus the ink coloring material readily adheres to the decurling roller 60. To cope with this, in this embodiment, a temperature sensor and a hygro-sensor are provided in the periphery of the decurling roller 60, and the temperature and humidity in the periphery of the decurling roller 60 are measured and monitored. Then, the conveyance delay time is decided based on the temperature and humidity near the decurling roller 60.

Figure 14:
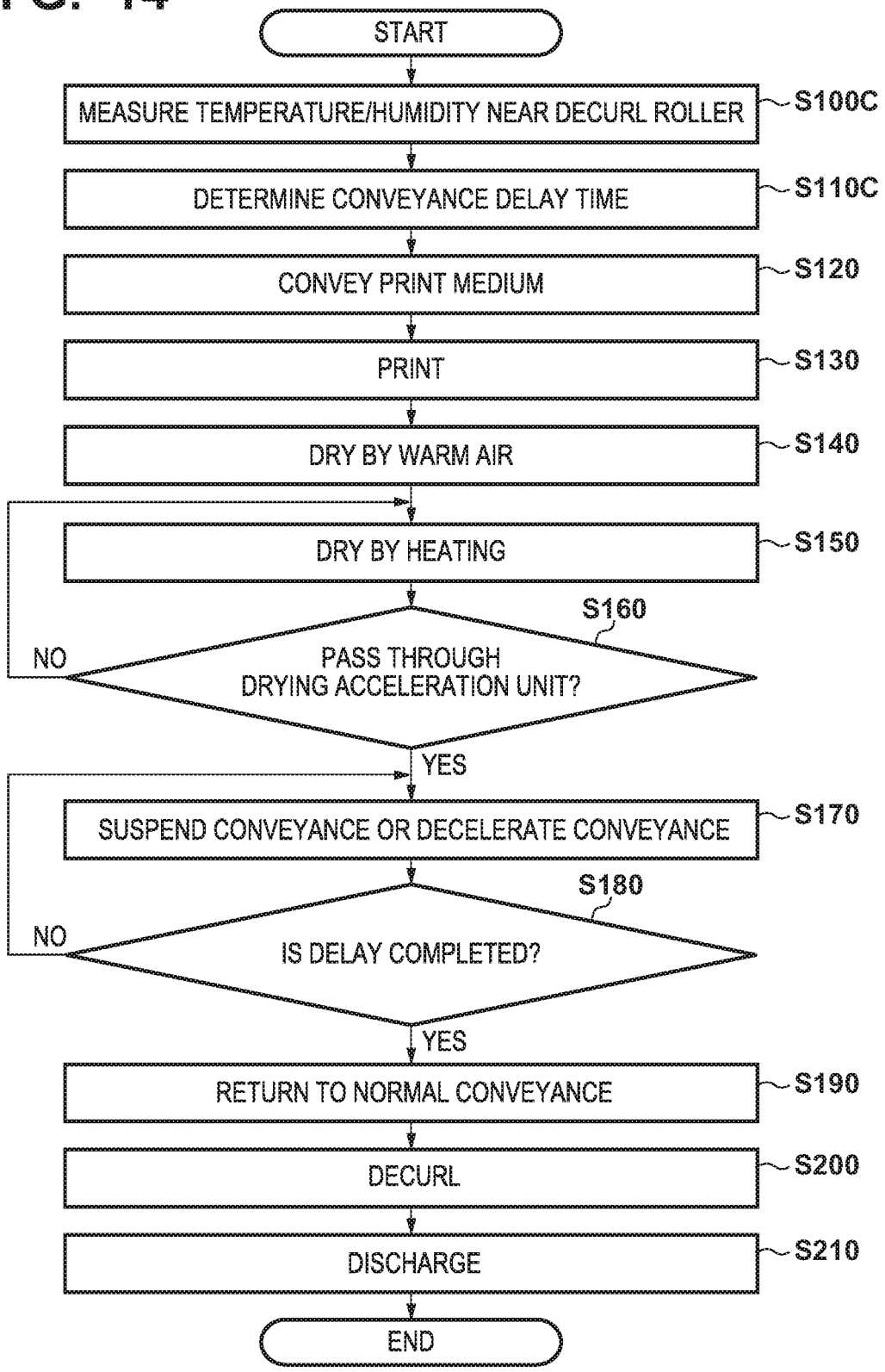
FIG. 14 is a flowchart illustrating conveyance control of a print medium according to the fifth embodiment.
Figure 15:
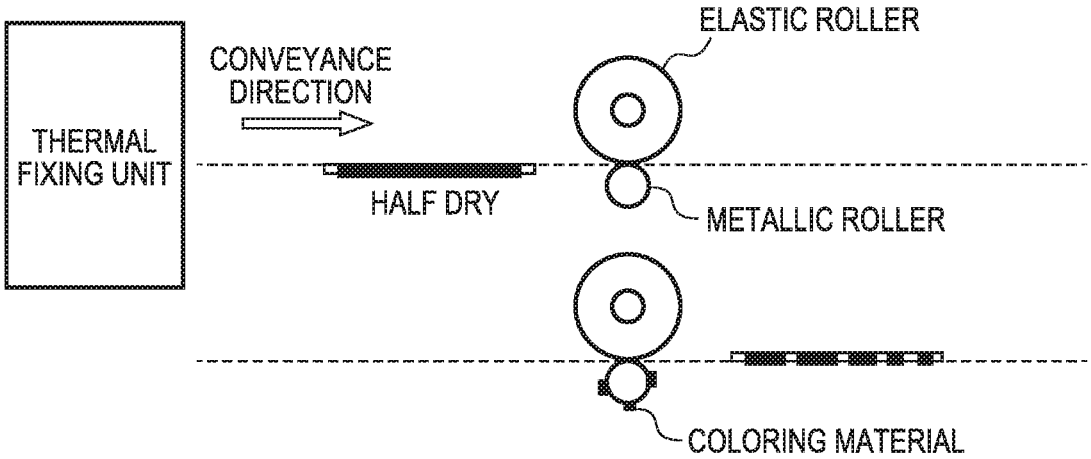
FIG. 15 is a view showing a state in which an image undergoes thermal fixing by a thermal fixing unit and a print medium in the half dry state enters conveyance rollers.

FIG. 14 is a flowchart illustrating conveyance control of a print medium according to the fifth embodiment. Note that in FIG. 14, the same step numbers as those described with reference to FIG. 11 denote the same processing steps and a description thereof will be omitted.

Referring to FIG. 14, in step S100C, the temperature and humidity near the decurling roller 60 are measured using the temperature sensor and the hygro-sensor. In step S110C, based on the measured temperature and humidity near the decurling roller 60, the conveyance delay time of the print medium on the conveyance path between the drying acceleration unit 50 and the correction unit 60 is decided. Note that to increase the processing speed, an LUT (lookup table) indicating the relationship between the temperature and humidity and the conveyance delay time of the print medium may be provided, and the CPU may access the LUT to decide the conveyance delay time of the print medium.

As described in the second embodiment, the processes in steps S120 to S210 are then executed.

Therefore, according to the above-described embodiment, it is possible to control the conveyance timing of the print medium after drying by heating to the decurling roller based on the measured temperature and humidity near the decurling roller.

Note that in each of the second to fifth embodiments, the conveyance delay time is decided based on one factor. However, the present invention is not limited to this, and the conveyance delay time may be decided by combining two or more of the factors described in the second to fifth embodiments.

Other Embodiments

Embodiment(s) of the present invention can also be realized by a computer of a system or apparatus that reads out and executes computer executable instructions (e.g., one or more programs) recorded on a storage medium (which may also be referred to more fully as anon-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-164784, filed Sep. 10, 2019, which is hereby incorporated by reference herein in its entirety.

What is claimed is:

1. A printing apparatus comprising:

a conveyance unit configured to convey a print medium;

a printhead configured to print an image by discharging ink to the print medium conveyed by the conveyance unit;

a heating unit provided downstream of the printhead with respect to a conveyance direction of the print medium and configured to heat the print medium on which the image is printed by the printhead;

a correction unit provided downstream of the heating unit with respect to the conveyance direction and configured to correct curl occurring in the print medium; and a control unit configured to control a conveyance speed of the conveyance unit so as to convey the print medium at a first speed between the printhead and the heating unit and to convey the print medium at a second speed slower than the first speed between the heating unit and the correction unit.

2. The apparatus according to claim 1, wherein the correction unit includes a roller configured to correct the curl occurring in the print medium by pressing the print medium.

3. The apparatus according to claim 2, wherein the roller comprises a roller pair of a first roller covered with an elastic member and a second roller made of a metal, and presses the print medium by the first roller and the second roller.

4. The apparatus according to claim 1, further comprising a drying unit provided between the printhead and the heating unit and configured to dry, by warm air, the print medium on which the image is printed by the printhead.

5. The apparatus according to claim 1, further comprising a calculation unit configured to calculate, based on print data input from a host apparatus, an ink application amount discharged to one print medium by the printhead, wherein the control unit determines a time for delaying the conveyance of the print medium, which has been heated by the heating unit, between the heating unit and the correction unit based on the ink application amount calculated by the calculation unit, and controls the second speed based on the time for delaying the conveyance.

6. The apparatus according to claim 5, wherein the heating unit includes a heater configured to heat the print medium, and the control unit determines the time for delaying the conveyance of the print medium between the heating unit and the correction unit based on the ink application amount calculated by the calculation unit and a heating capability of the heater.

7. The apparatus according to claim 1, further comprising a discrimination unit configured to discriminate a type of a print medium fed from a feeding apparatus on which a plurality of print media are stacked, wherein the control unit determines a time for delaying the conveyance of the print medium, which has been heated by the heating unit, between the heating unit and the correction unit based on the type of the print medium discriminated by the discrimination unit, and controls the second speed based on the time for delaying the conveyance.

8. The apparatus according to claim 1, further comprising:

a temperature sensor configured to measure a temperature near the correction unit; and a hygro-sensor configured to measure a humidity near the correction unit, wherein the control unit determines a time for delaying the conveyance of the print medium, which has been heated by the heating unit, between the heating unit and the correction unit based on the temperature measured by the temperature sensor and the humidity measured by the hygro-sensor, and controls the second speed based on the time for delaying the conveyance.

9. The apparatus according to claim 1, wherein the print medium is a cut sheet, and the correction unit is provided away from the heating unit by not less than a length of the print medium with respect to the conveyance direction.

10. The apparatus according to claim 1, wherein the print medium is a cut sheet, and the printhead has nozzles to discharge ink which are arrayed within a range where the nozzles cover the width of an image printing area of a print medium having a maximum usable size.

11. A control method for a printing apparatus including a conveyance unit configured to convey a print medium, a printhead configured to print an image by discharging ink to the print medium conveyed by the conveyance unit, a heating unit provided downstream of the printhead with respect to a conveyance direction of the print medium and configured to heat the print medium on which the image is printed by the printhead, and a correction unit provided downstream of the heating unit with respect to the conveyance direction and configured to correct curl occurring in the print medium, the method comprising:

controlling a conveyance speed of the conveyance unit so as to convey the print medium at a first speed between the printhead and the heating unit and to convey the print medium at a second speed slower than the first speed between the heating unit and the correction unit.

12. The method according to claim 11, wherein the correction unit includes a roller configured to correct the curl occurring in the print medium by pressing the print medium, and in the controlling, the conveyance of the print medium to the roller is delayed until a printing surface of the print medium is dried.

13. The method according to claim 11, further comprising drying, by warm air, the print medium, on which the image is printed by the printhead, between the printhead and the heating unit with respect to the conveyance direction.

14. The method according to claim 11, further comprising calculating, based on print data input from a host apparatus, an ink application amount discharged to one print medium by the printhead, wherein in the controlling, a time for delaying the conveyance of the print medium, which has been heated by the heating unit, between the heating unit and the correction unit is determined based on the calculated ink application amount, and the second speed is controlled based on the time for delaying the conveyance.

15. The method according to claim 11, further comprising discriminating a type of a print medium fed from a feeding apparatus on which a plurality of print media are stacked, wherein in the controlling, a time for delaying the conveyance of the print medium, which has been heated by the heating unit, between the heating unit and the correction unit is determined based on the discriminated type of the print medium, and the second speed is controlled based on the time for delaying the conveyance.

16. The method according to claim 11, wherein if a temperature sensor configured to measure a temperature near the correction unit and a hygro-sensor configured to measure a humidity near the correction unit are provided, a time for delaying the conveyance of the print medium, which has been heated by the heating unit, between the heating unit and the correction unit is determined in the controlling based on the temperature measured by the temperature sensor and the humidity measured by the hygro-sensor, and the second speed is controlled based on the time for delaying the conveyance.

17. The method according to claim 11, wherein the print medium is a cut sheet, and the correction unit is provided away from the heating unit by not less than a length of the print medium with respect to the conveyance direction.

18. A printing apparatus comprising:

a conveyance unit configured to convey a print medium;

a printhead configured to print an image by discharging ink to the print medium conveyed by the conveyance unit;

a heating unit provided downstream of the printhead with respect to a conveyance direction of the print medium and configured to heat the print medium on which the image is printed by the printhead;

a correction unit provided downstream of the heating unit with respect to the conveyance direction and configured to correct curl occurring in the print medium; and a control unit configured to control to stop temporarily the conveyance of the print medium, which has been heated by the heating unit and is conveyed between the heating unit and the correction unit, so as to delay a timing at which the print medium enters the correction unit.

19. The apparatus according to claim 18, further comprising a calculation unit configured to calculate, based on print data input from a host apparatus, an ink application amount discharged to one print medium by the printhead, wherein the control unit determines a time for delaying the conveyance of the print medium, which has been heated by the heating unit and is conveyed between the heating unit and the correction unit, based on the ink application amount calculated by the calculation unit, and controls to stop temporarily the conveyance of the print medium, which has been heated by the heating unit and is conveyed between the heating unit and the correction unit.

20. The apparatus according to claim 18, wherein the heating unit includes a heater configured to heat the print medium, and the control unit determines the time for delaying the conveyance of the print medium, which has been heated by the heating unit and is conveyed between the heating unit and the correction unit, based on the ink application amount calculated by the calculation unit and a heating capability of the heater, and controls to stop temporarily the conveyance of the print medium, which has been heated by the heating unit and is conveyed between the heating unit and the correction unit.

21. The apparatus according to claim 18, further comprising a discrimination unit configured to discriminate a type of a print medium fed from a feeding apparatus on which a plurality of print media are stacked, wherein the control unit determines a time for delaying the conveyance of the print medium, which has been heated by the heating unit and is conveyed between the heating unit and the correction unit, based on the type of the print medium discriminated by the discrimination unit, and controls to stop temporarily the conveyance of the print medium, which has been heated by the heating unit and is conveyed between the heating unit and the correction unit.

22. The apparatus according to claim 18, further comprising:

a temperature sensor configured to measure a temperature near the correction unit; and a hygro-sensor configured to measure a humidity near the correction unit, wherein the control unit determines a time for delaying the conveyance of the print medium, which has been heated by the heating unit and is conveyed between the heating unit and the correction unit, based on the temperature measured by the temperature sensor and the humidity measured by the hygro-sensor, and controls to stop temporarily the conveyance of the print medium, which has been heated by the heating unit and is conveyed between the heating unit and the correction unit.

23. The apparatus according to claim 18, wherein the print medium is a cut sheet, and the printhead has nozzles to discharge ink which are arrayed within a range where the nozzles cover the width of an image printing area of a print medium having a maximum usable size.

24. A control method for a printing apparatus including a conveyance unit configured to convey a print medium, a printhead configured to print an image by discharging ink to the print medium conveyed by the conveyance unit, a heating unit provided downstream of the printhead with respect to a conveyance direction of the print medium and configured to heat the print medium on which the image is printed by the printhead, and a correction unit provided downstream of the heating unit with respect to the conveyance direction and configured to correct curl occurring in the print medium, the method comprising:

temporarily stopping the conveyance of the print medium, which has been heated by the heating unit, between the heating unit and the correction unit, so as to delay a timing at which the print medium enters the correction unit.

* * * * *